United States Patent [19]

Ehrsam

[11] 4,308,695

[45] Jan. 5, 1982

[54] PRESSURE-RELIEVING FACADE

[75] Inventor: Ruedi Ehrsam, Riehen, Switzerland

[73] Assignee: Eltreva AG, Aesch, Switzerland

[21] Appl. No.: 77,773

[22] Filed: Sep. 21, 1979

[51] Int. Cl.[3] ..... E04B 1/98; E04B 2/88

[52] U.S. Cl. ..... 52/1; 52/235; 52/394

[58] Field of Search ..... 52/511, 235, 538, 539, 52/542, 394, 403, 206

[56] References Cited

U.S. PATENT DOCUMENTS

| | | | |
|---|---|---|---|
| 2,135,118 | 11/1938 | Stewart | 52/396 |
| 2,277,792 | 3/1942 | Small | 52/489 |
| 2,286,890 | 6/1942 | Birt | 52/489 |
| 2,963,825 | 12/1960 | Douglas | 52/206 |
| 3,112,535 | 12/1963 | Kinney | 52/206 |

FOREIGN PATENT DOCUMENTS

| | | | |
|---|---|---|---|
| 1094496 | 12/1954 | France | 52/206 |

*Primary Examiner*—John E. Murtagh
*Attorney, Agent, or Firm*—Michael J. Striker

[57] ABSTRACT

A pressure-relieving facade structure for a building has a plurality of slab-like elements, a plurality of retaining legs each extending from one of the slab-like elements toward the facade of the building and having a thickened clamping projection at its free end, and a plurality of elastic receiving elements attached to the facade of the building and releasably receiving the clamping projections of the retaining legs with elastic clamping action.

15 Claims, 1 Drawing Figure

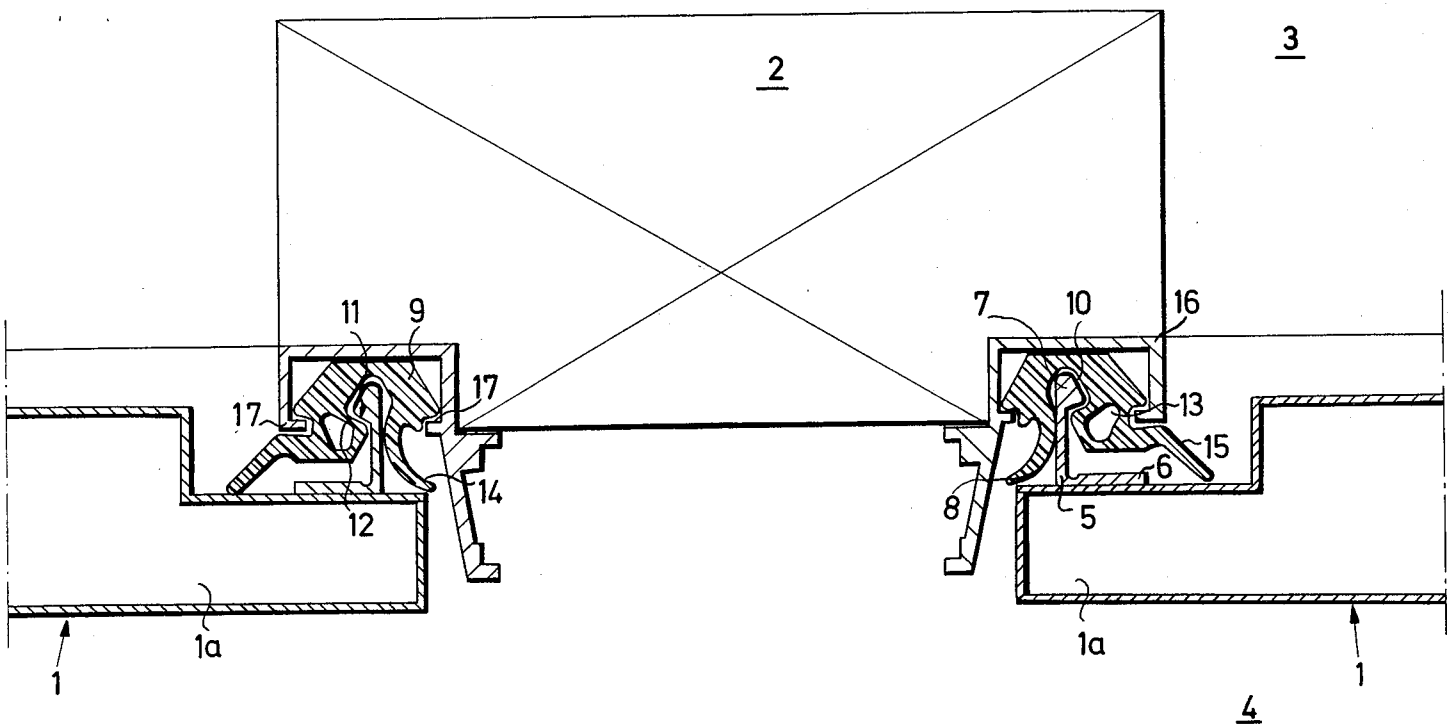
3
2
16
13
15
6
10
5
7
8
1
1a
4
17
14
9
11
12
17
1a
1

PRESSURE-RELIEVING FACADE

BACKGROUND OF THE INVENTION

The invention relates to a pressure-relieving facade for buildings that may be endangered by sudden pressure differentials.

Sudden pressure differentials may be caused by deflagrations, explosions or detonations, wherein the velocity of the pressure rise is lowest with deflagrations and highest with detonations. In order to prevent a sudden pressure rise from destroying the entire building, it will be necessary to provide within the facade for several "predetermined breaking points". It has been customary hitherto to provide as these "predetermined breaking points", windows with especially thin glazing. If the pressure rise within the building reached a certain value, these thin-glazed windows will burst and thus allow for a rapid pressure relief; all load-bearing wall sections will remain undamaged herein.

By the CH Letters Pat. 531,124, a solution has become known in which glass panes with the bursting characteristics of thermally pretensioned glass are used. A pointed stop is installed at the low-pressure side of every pane in such a manner that the distance to the pane is smaller than that maximum deflection of the zone of the pane below the stop, which the pane may be subjected to just short of bursting.

A precondition for such suggested solutions as known, is a sufficiently large glass area relative to the total facade, this in order to ensure a sufficiently rapid pressure relief in case of a sudden pressure rise. Such a precondition is, for instance, not given any more when the individual parts of the building form closed sectors with a facade on only one side.

SUMMARY OF THE INVENTION

The invention is based upon the task of developing a pressure-relieving facade with an enlarged portion of the facade area serving for pressure relief.

As per invention, this task is solved by slab-shaped wall elements, preferably those portions of parapets located below the windows, each having along the perimeter zone of their side facing the building retaining legs standing perpendicular to the plane of the facade and which transit at their free end into a thickend clamping edge, the latter being pressed into the clamping slot of a plastic molding which is fixedly attached to the facade and held elastically therein in such a manner that it may release itself.

As per invention, it is also the wall areas located below the windows that are included, apart from the windows, into the pressure-relieving zone. For installing, the wall elements are pressed into the plastic molding, perpendicular to the plane of the facade, the plastic shapes being made of rubber, neoprene or similar, and attached to the facade in such a manner that they will retain their original position even then when the wall elements are being pressed out of their clamping hold in case of a sudden pressure rise. The elastic engagement is preferably so designed that the wall element will be released at a pressure prevailing in the interior space of 0,05–0,1 bar.

In an appropriate design, the clamping edge, when viewed in its cross section in the direction of pressing-in, may have a steep running-up gradient transiting into a bevelled-off running-down gradient which is held from behind by a clamping lip of the plastic molding, the lip transiting into a clamping slot that tapers outward towards the outside of the facade. On one hand, this will ensure easy pushing-in of the clamping edge into its elastic engagement. On the other however, it is achieved in a surprising manner that this elastic engagement will accommodate the wind-suction forces acting on the wall element, but will be released nearly instantly upon a certain pressure being reached within the interior space. This effect can additionally be ensured by the clamping lip delimiting an all-enclosed cavity within the plastic molding arranged behind the lip in the direction of pulling out. This will ensure on one hand sufficient strength, and, on the other sufficent flexibility of the clamping lip.

In an appropriate further development, the plastic molding may be provided with a first sealing lip covering the retaining leg of the wall element towards the exterior and resting against the perimeter of the wall element. Additionally, the plastic molding may be provided with a second sealing lip, covering the retaining leg of the wall element towards the interior and resting against the interior side of the wall element. The plastic molding thus serves not only for the retaining of a wall element but also for its sealing.

At the same time, the plastic Molding as per invention provides outstanding sound attenuation. The retaining leg of the wall element is covered all around by the sealing lips of the plastic molding, wherein neither the mounting nor the sealing are visible from the outside, so that an optically appealing solution is the result. Furthermore, the plastic moldings and also their sealing lips are so located that they are protected against sunrays.

The plastic molding may preferably be held within a metallic shape. The latter may be of a U section wherein, at the free edges of the two U legs, an incision may be provided for retaining the plastic molding. On one hand this will allow easy installing of the plastic molding, and on the other, this will ensure that, on releasing the wall element, the plastic molding will not also be pulled out of the shape.

The retaining leg may be part of an angle shape attached to the interior side of the wall element. Furthermore, the wall elements may be recessed at their perimeter zone so that the gap between retaining structure and the wall elements may be reduced.

The clamping edge of the retaining leg may show comb-like incisions. This will reduce the length along which the clamping edge is held within the plastic molding. By selecting the number and/or length of the incisions in the longitudinal direction of the shape, it will be easy to adapt the clamped connection to various pressure conditions.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE of the drawing shows in an excerpt a horizontal section through a pressure-relieving facade structure in accordance with the present invention.

SUMMARY OF THE INVENTION

The drawing shows two adjacent slab-type wall elements 1, which may be parts of a parapet arranged below the windows. Only the fastening zone of two adjacent wall elements is shown. All other details of the construction of the facade and the arrangements of the windows and their design have been omitted. Merely a post 2 of the load-carrying structure of the facade is indicated in the schematic. The building zone is identified by 3 and the weather-facing outside by 4.

The wall elements 1 are recessed in their perimeter zone and provided herein at their side facing the building 3 with a retaining leg 5, extending around its perimeter and standing vertically to the plane of the facade. The retaining leg 5 is part of an angle shape 6 which may be riveted onto the interior side of the wall element 1 or fastened to it in any other manner. With its free edge, the retaining leg 5 transits into a thickened clamping edge 7 which is pressed into a clamping slot 8 of a plastic molding 9, fixedly attached to the facade and held therein in elastic engagement so that it may be released.

Seen in its section, the clamping edge 7 has a steep running-up gradient 10 which transits into a bevelled running-off gradient 11. The latter is held from behind by a clamping lip 12 of the plastic molding 9, which transits into the clamping slot 8 tapering outward towards the exterior side of the facade and which delimits an all-enclosed cavity 13 within the shape, arranged behind it in the direction of pulling out.

The plastic molding 9 has a first sealing lip 14, covering the retaining leg 5 of the wall element 1 towards the outside 4 facing the weather and resting against the perimeter of the wall element. The plastic molding 9 furthermore has a second sealing lip 15, covering the retaining leg 5 of the wall element towards the interior and resting against the interior side of the wall element.

The plastic molding 9 is held within a metallic shape 16 which is of an U-shaped cross section. A rectangular incision is arranged at the respective free edges of the two U legs, holding from behind the plastic molding 9, or engaging, respectively, a corresponding slot of this plastic molding.

It will be understood that each of the elements described above, or two or more together, may also find a useful application in other types of constructions differing from the types described above.

While the invention has been illustrated and described as embodied in a pressure-relieving facade structure, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A pressure-relieving facade structure for a building, comprising a plurality of slab-like elements spaced from one another in a first direction and extending in a second direction which is transverse to said first direction which directions lie in a plane substantially parallel to the plane of a facade of a building; at least one retaining leg extending from each of said slab-like elements toward the facade normal to the plane of the latter, said retaining leg having a free end portion which faces toward the facade and is thickened; and a plurality of elastic receiving elements fixedly attached to the facade of the building and each releasably receiving said thickened end portion of a respective one of said retaining legs with elastic clamping action, each of said receiving elements having a first sealing lip covering said retaining leg of a respective one of said slab-like elements from outside of the latter, and a second sealing lip covering said retaining leg of a respective one of said slab-like elements from inside of the latter.

2. A pressure-relieving facade structure as defined in claim 1, wherein the building has windows, said slab-like elements forming portions of parapets below the windows of the building.

3. A pressure-relieving facade structure as defined in claim 1, wherein said thickened end portion of each of said retaining legs is formed as a clamping projection, each of said receiving elements being provided with a clamping slot form-lockingly receiving the clamping projection of a respective one of said retaining legs.

4. A pressure-relieving facade structure as defined in claim 1, wherein each of said receiving elements is constituted of a synthetic plastic material.

5. A pressure-relieving facade structure as defined in claim 1, wherein said retaining legs and said receiving elements are arranged so as to provide such a clamping force that said retaining legs can be released from said receiving elements at an inner pressure of 0.05–0.1 bar.

6. A pressure-relieving facade structure as defined in claim 3, wherein said clamping projection of each of said retaining legs has a cross-section which includes a first section decreasing in a direction toward the facade, and a second section merging into said first section and decreasing in a direction away from the facade, said clamping slot of each of said receiving element being formed by a wall which has one section formed as a clamping lip and engaging said second section of said clamping projection of a respective one of said legs, at a side opposite to the facade.

7. A pressure-relieving facade structure as defined in claim 6, wherein said clamping slot of each of said receiving elements has another section located farther from the facade than said one section and having a dimension, as considered in said first direction, which increases in the direction away from the facade, said one section of said clamping slot transiting into the other section of the latter.

8. A pressure-relieving facade structure as defined in claim 1, wherein each of said receiving elements has a first sealing lip covering said retaining leg of a respective one of said slab-like elements from outside of the latter.

9. A pressure-relieving facade structure as defined in claim 8, wherein each of said slab-like elements has an outer marginal edge, each of said first sealing lips resting on said marginal edge of a respective one of said slab-like elements.

10. A pressure-relieving facade structure as defined in claim 1, wherein each of said slab-like elements has an inner face, each of said second sealing lips resting on said inner face of a respective one of said slab-like elements.

11. A pressure-relieving facade structure as defined in claim 1; and further comprising a plurality of metallic profiled elements attached to the building, each of said receiving elements being received in a respective one of said metallic profiled elements.

12. A pressure-relieving facade structure as defined in claim 1; and further comprising a plurality of holding legs each integral with a respective one of said retaining legs and extending at an angle relative to the latter so as to form a one-piece angled member, each of said slab-like elements having an inner face to which said holding leg of a respective one of said retaining legs is attached.

13. A pressure-relieving facade structure as defined in claim 1, wherein each of said slab-like elements has a marginal portion provided with a recess, each of said retaining legs and each of said receiving elements being located in the region of said recess of said marginal portion of a respective one of said slab-like elements.

14. A pressure-relieving facade structure as defined in claim 1, wherein said thickened end portion of each of said reinforcing legs has a plurality of comb-like incisions.

15. A pressure-relieving facade structure for a building, comprising a plurality of slab-like elements spaced from one another in a first direction and extending in a second direction which is transverse to said first direction which directions lie in a plane substantially parallel to the plane of a facade of a building; at least one retaining leg extending from each of said slab-like elements toward the facade normal to the plane of the latter, said retaining leg having a free end portion which faces toward the facade and is thickened, said thickened end portion of each of said retaining legs being formed as a clamping projection having a cross-section which includes a first section decreasing in a direction toward the facade, and a second section merging into said first section and decreasing in a direction away from the facade; and a plurality of elastic receiving elements fixedly attached to the facade of the building and each releasably receiving said thickened end portion of a respective one of said retaining legs with elastic clamping action, each of said receiving elements being provided with a plurality of clamping slots each form-lockingly receiving the clamping projection of a respective one of said retaining legs, said clamping slot of each of said receiving elements being formed by a wall which has one section formed as a clamping lip and engaging said second section of said clamping projection of a respective one of said legs, at a side opposite to the facade, each of said receiving elements having a completely closed cavity which is located farther from the facade than said clamping lip and is limited by the latter.

* * * * *